United States Patent [19]

Hermann

[11] 4,455,209

[45] Jun. 19, 1984

[54] ELECTRODE FRAME FOR THE ELECTROLYTIC RECOVERY OF METALS

[75] Inventor: Manfred P. Hermann, Nuremberg, Fed. Rep. of Germany

[73] Assignee: J V Kunststoffwerk GmbH, Georgensgmünd, Fed. Rep. of Germany

[21] Appl. No.: 500,874

[22] Filed: Jun. 3, 1983

[30] Foreign Application Priority Data

Jun. 5, 1982 [DE] Fed. Rep. of Germany ..... 3221371

[51] Int. Cl.[3] ..... C25C 7/00; C25C 7/04

[52] U.S. Cl. ..... 204/279; 204/282; 204/286

[58] Field of Search ..... 52/222; 160/374.1, 378; 204/279, 282–283, 286–287

[56] References Cited

U.S. PATENT DOCUMENTS

| | | | |
|---|---|---|---|
| 1,325,961 | 12/1919 | Smith | 160/378 |
| 3,211,089 | 10/1965 | Messerschmitt | 160/378 X |
| 3,914,887 | 10/1975 | Newman | 160/378 X |
| 4,396,484 | 8/1983 | Peré et al. | 204/279 X |

FOREIGN PATENT DOCUMENTS 2853672 6/1980 Fed. Rep. of Germany .

*Primary Examiner*—Donald R. Valentine
*Attorney, Agent, or Firm*—Spencer & Frank

[57] ABSTRACT

An electrode frame for the electrolytic recovery or purification of metals comprises four frame arms (1–4). It serves to tension a filter cloth arranged on both sides of the frame plane between which the interior (5) of the frame is enclosed. In order to keep constant the tension of the filter cloths, at least one (4) of the arms (1–4) is flanked by a pressure bar (6) which extends essentially parallel thereto, is spaced therefrom and is charged with spring pressure in a direction (7) leading away from the frame interior (5).

11 Claims, 8 Drawing Figures

ELECTRODE FRAME FOR THE ELECTROLYTIC RECOVERY OF METALS

BACKGROUND OF THE INVENTION

The invention relates to an electrode frame for use in the electrolytic recovery or purification of metals, the frame being made of a thermosplastic synthetic material, preferably polypropylene, and having an upper and a lower horizontal arm and two lateral arms for connecting together the upper and lower horizontal arms. Such an electrode frame is disclosed in German Offenlegungsschrift No. 2,853,672.

In the electrolytic recovery of metals, for example copper, nickel, silver or the like, an anode of an inert material, for example lead, and a cathode on which the metal is to be precipitated are disposed in a common electrolyte. The cathode is here connected with the negative terminal and the anode with the positive terminal of a direct current source. Frequently, the cathode and anode chambers are separated from one another by a diaphragm and circulating pumps are provided to convey the electrolyte into the cathode chamber. The electrodes themselves generally are rectangular plates of different weights, with the weights possibly increasing up to an order of magnitude of 100 kg. Particularly for the cathode the situation is such that initially, at the beginning of the electrolysis process, the cathode is a relatively thin metal starter sheet which then grows in the course of the electrolysis process and likewise reaches weights in the order of magnitude from 50 to 100 kg, sometimes even more.

The described process of electrolytic metal recovery can also be used, with slight modifications, for the electrolytic purification of metals, for example copper, nickel, silver or the like. In this case, the anode is made of the metal to be purified and is immersed together with the cathode in the common electrolyte. During the passage of current, the metal to be purified is precipitated on the cathode with equivalent quantities simultaneously being removed from the anode.

To prevent the electrodes from touching one another and in order to facilitate the exchange of electrodes, the electrodes are generally surrounded by a frame which absorbs the weight of the electrodes and transfers it to the walls of the electrolysis vessel. The frame itself is made of electrolytically nonconductive material, which is necessary since otherwise metal would also precipitate on the frame and, in particular, the cathode would grow to become part of the frame. To complete the separation, a diaphragm cloth is stretched over the frame together with its contents, this cloth being either attached to special fastening devices on the frame or is simply pulled over the frame and the electrodes therein in the manner of a flat tube or bag.

It has been found that these cloths are easily disposed on the frame with too much or too little tension. This is also due to the fact that during the duration of use of the electrode frames, these cloths change in consistency. Too much tension is usually the result of cloth shrinkage and causes the weave to become more open. Too little tension may permit, for example, nickel to grow into the cloth so that the plate can no longer be removed from the frame and the stress on the frame now becomes nonuniform. If the covering is formed of a cloth bag, its dimensions must be maintained very accurately during manufacture if the desired cloth tension is to be kept within comparatively close tolerances.

SUMMARY OF THE INVENTION

It is an object of the invention to provide an electrode frame of the above-mentioned type which assures uniform cloth tension for the duration of use of the electrode frame. This is accomplished by the present invention wherein at least one of the arms of the frame is flanked by a pressure bar at a side of the at least one arm which faces away from the frame interior, the pressure bar extending essentially parallel to the at least one arm and being adjacent thereto. According to the invention the pressure bar is charged by spring pressure in a direction leading away from the frame interior and perpendicular to the longitudinal dimension of the at least one arm. The pressure bars under spring pressure exert a tension force of certain magnitude on the tensioned filter cloth or the tensioned filter cloth bag, respectively, so that loose cloths are tightened and cloth shrinkage is compensated for by yielding. For example, the spring elements may be formed of helical springs or elastic rubber elements.

According to one advantageous feature of the invention cloth bags no longer need be sewn rather a cloth can simply be clamped in, for example one on each side of the frame. According to another particularly advantageous feature of the invention the cloth forms a tight seal with the electrode frame even in the region of the rubber spring element which connects the pressure bar.

BRIEF DESCRIPTION OF THE DRAWINGS

The subject matter of the invention will now be explained in an exemplary manner with the aid of the drawings. It is shown in.

DESCRIPTION OF THE PREFERRED EMBODIMENTS

Figures 1, 2, 3, 4, 5, 6:
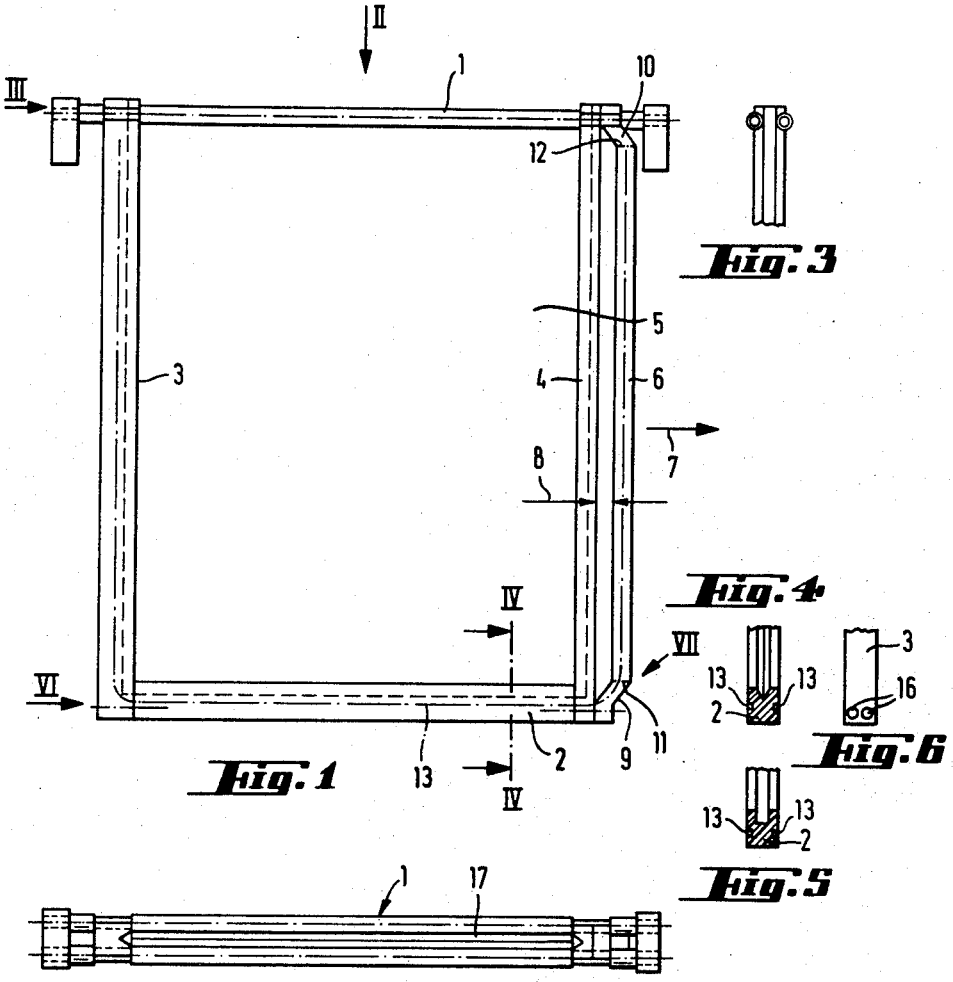
FIG. 1, a plan elevational view of an electrode frame designed according to the invention seen perpendicularly to the plane of the frame.
FIG. 2, an end elevational view in the direction of arrow II in FIG. 1.
FIG. 3, a partial end elevational view in the direction of arrow III in FIG. 1.
FIGS. 4 and 5, respective partial end elevational views in the direction of arrows IV—IV showing alternative shapes of frame arms.
FIG. 6, a partial end elevational view in the direction of arrow VI in FIG. 1.

The frame according to FIG. 1 comprises the upper horizontal arm 1, the lower horizontal arm 2 as well as the two lateral arms 3, 4. Arms 1–4 are preferably made of polypropylene. On its side facing away from frame interior 5, the right lateral arm 4 is flanked by a pressure bar 6 extending parallel to the lateral arm 4 and which is charged by spring pressure in a direction facing away from the frame interior 5 at a right angle to the longitudinal direction of lateral arms 3, 4, as shown by arrow 7. Pressure bar 6 extends at a distance 8 parallel to its adjacent right lateral arm 4 so as to assure a sufficient spring path also for resilient inward spring action. The spring elements are formed of rubber blocks 9, 10, which are attached to the two ends 11, 12 of pressure bar 6 and, as an extension of the latter, produce a transition to the ends of the adjacent lateral arm 4 and the adjacent horizontal arms 1, 2, respectively, as more clearly shown in FIG. 7.

Figure 8:
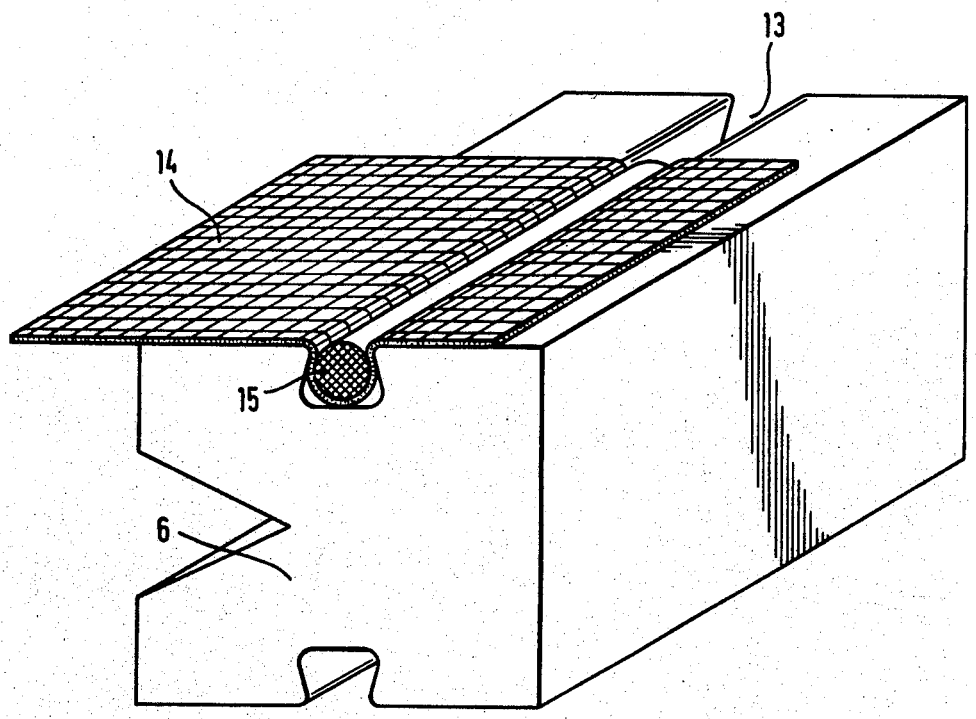
FIG. 8, a perspective view in partial cross section of a portion of a frame arm or a pressure bar of the frame shown in FIG. 1 having a filter cloth which is fixed in a circumferential groove.

On its side parallel to the frame plane, the frame is provided with a circumferential dovetail groove 13 which is intended for insertion of an endless cord 15 for fixing the filter cloth 14 in the manner shown in FIG. 8. In cases where one exterior side of the frame is formed of a pressure bar 6, groove 13 extends along the pressure bar 6 and not along lateral arm 4 which extends parallel thereto. Groove 13 here penetrates the side faces of rubber blocks 9, 10.

Figure 7:
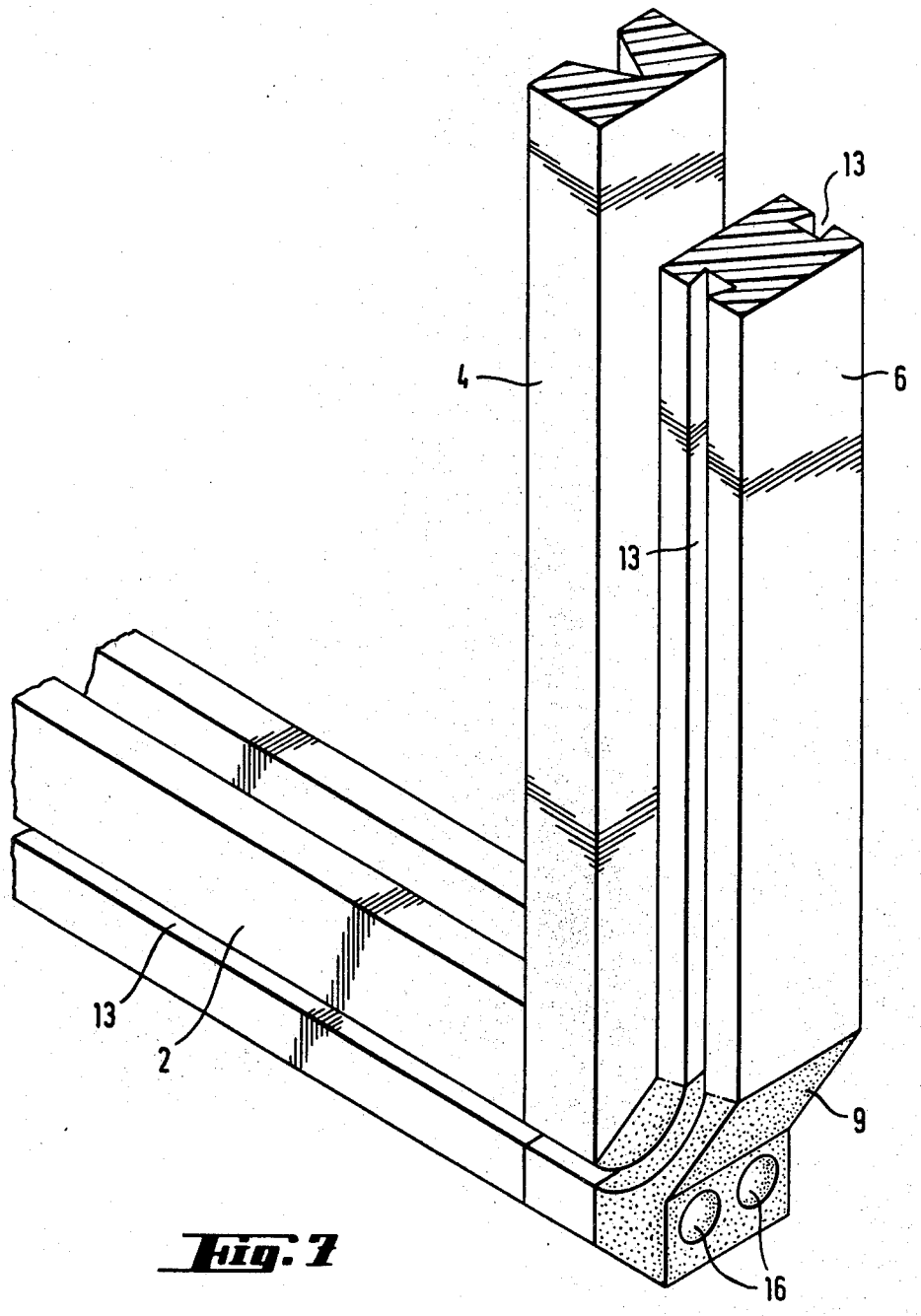
FIG. 7, a perspective view of the lower right-hand frame arm abutment seen in the direction of arrow VII in FIG. 1.

In FIG. 7, the dovetail grooves 13 are shown again in lower horizontal arms 2 and lateral arm 4. Bores for receiving installation screws are marked 16.

As shown in FIG. 2, the upper horizontal arm 1 is provided with a slit 17 for inserting and removing the electrodes. If the frame is to be used as a cathode frame, the starter sheet is inserted through slit 17 at the beginning of work and the grown cathode is removed through there at the end of the electrolysis process. If the frame is to be used as anode frame, the maximum size anode plate must be pushed through slit 17 at the beginning of the electrolysis process and at the end, any remaining anode rests must be removed through slit 17.

If the filter cloths which cover the frame interior on both sides are formed by a cloth bag, the latter, in order to fix it in the frame, is pulled from the bottom to the top over the lower horizontal arm 2 and the two lateral arms 3 and 4. Its upper hem is fixed by means of bands to the upper horizontal arm 1. The tensioned filter cloths or the two sides of the filter cloth bag, respectively, are subjected to the desired tension. If this tension changes during the period of operation of the electrode frame, the distance 8 between pressure bar 6 and adjacent lateral arm 4 increases or decreases depending on the particular change. In this way, care is being taken that there is a uniform tension in the filter cloths in their regions covering the frame interior 5. Moreover, this counteracts any deformation, for example of the strong lateral arms 3,4, due to shrinkage of the cloth.

I claim:

1. Electrode frame for the electrolytic recovery or purification of metals including an upper and a lower horizontal arm as well as two lateral arms for connecting together the upper and lower horizontal arms, the arms each having a longitudinal dimension and preferably being made of polypropylene, characterized in that at its side facing away from the frame interior (5) at least one of the arms (1–4) is flanked by a pressure bar (6) which extends essentially parallel to the at least one arm and is adjacent thereto, with the pressure bar being charged by spring pressure in a direction (7) leading away from the frame interior (5) and perpendicular to the longitudinal dimension of the at least one arm.

2. Electrode frame for the electrolytic recovery or purification of metals including an upper and a lower horizontal arm as well as two lateral arms for connecting together the upper and lower horizontal arms, the arms preferably being made of polypropylene, characterized in that at least one of the arms (1–4) is itself formed by a pressure bar which is arranged to be continuously charged by an uninterrupted spring pressure in a direction (7) leading away from the frame interior (5).

3. Frame according to claim 1 or 2, characterized in that the pressure bar (6) is supported at an adjacent frame arm (1, 2, 4) by means of spring elements attached, in particular, to its ends.

4. Frame according to claim 1 or 2, characterized in that the pressure bar (6) extends parallel to one frame arm (4).

5. Frame according to claim 1 or 2 characterized in that only one vertical pressure bar (6) is provided.

6. Frame according to claim 1 or 2 characterized in that the pressure bar (6) extends, in particular, parallel to an adjacent frame arm (4) at a distance (8) bridged by a spring element.

7. Frame according to claim 1 or 2 characterized in that a spring element is made of, in particular, a thermoplastic rubber block (9, 10).

8. Frame according to claim 1 or 2 characteized in that the rubber block has the shape of a rhombohedron.

9. Frame according to claim 7, characterized in that a rubber block is attached at both ends of the pressure bar (6) so as to produce, as an extension of the pressure bar (6), the transition of the latter to the adjacent frame arm (1, 2, 4).

10. Frame according to claim 1 or 2 characterized in that on one exterior side, particularly on its sides which are parallel with the frame plane, the frame is provided with a circumferential groove (13), particularly a dovetail groove, for the insertion of an endless cord (15) for fixing a filter cloth (14), with the groove (13) being formed in the respective pressure bar (6).

11. An electrode frame arrangement for use in the electrolytic recovery or purification of a metal, comprising:

first and second spaced and substantially parallel arms;

third and fourth spaced and substantially parallel arms each connecting together said first and second arms to form a substantially planar frame, said frame enclosing an interior space and being constructed for holding an electrode within the interior space;

a pressure bar positioned on the exterior of said frame and arranged adjacent and parallel to one of said arms;

spring means connecting said pressure bar to said one arm and being arranged for charging said pressure bar in a direction which is outwardly from and parallel to a plane of said frame.

* * * * *